US010897075B2

(12) United States Patent
Cooley et al.

(10) Patent No.: US 10,897,075 B2
(45) Date of Patent: Jan. 19, 2021

(54) WIDEBAND REFLECTARRAY USING ELECTRICALLY RE-FOCUSABLE PHASED ARRAY FEED

(71) Applicant: Northrop Grumman Systems Corporation, Falls Church, VA (US)

(72) Inventors: Michael E. Cooley, Severna Park, MD (US); Bret J. Yon, Bowie, MD (US); David Sall, Owings Mills, MD (US); Robert J. March, Bel Air, MD (US); Scott A. Wilson, Baltimore, MD (US); John Hodge, Bowie, MD (US); Alyssa Harris, Hanover, MD (US); Nicholas Fasanella, Ventura, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 244 days.

(21) Appl. No.: 16/206,221

(22) Filed: Nov. 30, 2018

(65) Prior Publication Data

US 2020/0176858 A1 Jun. 4, 2020

(51) Int. Cl.

| | |
|---|---|
| ***H01Q 19/10*** | (2006.01) |
| ***H01Q 1/28*** | (2006.01) |
| ***H01Q 1/10*** | (2006.01) |
| ***H01Q 19/18*** | (2006.01) |
| ***H01Q 15/14*** | (2006.01) |
| ***H01Q 3/06*** | (2006.01) |

(52) U.S. Cl.

CPC ..... *H01Q 1/288* (2013.01); *H01Q 1/10* (2013.01); *H01Q 3/06* (2013.01); *H01Q 15/145* (2013.01); *H01Q 19/18* (2013.01)

(58) Field of Classification Search

CPC ..... H01Q 1/288; H01Q 1/10; H01Q 19/18; H01Q 15/145; H01Q 3/06

See application file for complete search history.

(56) References Cited

U.S. PATENT DOCUMENTS

| | | | | |
|---|---|---|---|---|
| 4,342,035 | A | 7/1982 | Anderson et al. | |
| 4,387,378 | A | 6/1983 | Henderson | |
| 4,578,680 | A | 3/1986 | Haupt | |
| 5,949,370 | A * | 9/1999 | Smith | H01Q 1/288 342/354 |
| 6,031,506 | A | 2/2000 | Cooley et al. | |
| 6,081,234 | A | 6/2000 | Huang et al. | |
| 6,429,823 | B1 | 8/2002 | Bains et al. | |
| 7,710,339 | B2 | 5/2010 | Forslund | |

(Continued)

OTHER PUBLICATIONS

M. H. Dahri, et al. "A Review of Wideband Reflectarray Antennas for 5G Communication Systems" IEEE Access, Aug. 2017, vol. 5, pp. 17803-17815.

*Primary Examiner* — Dieu Hien T Duong

(74) *Attorney, Agent, or Firm* — Edell, Shapiro & Finnan, LLC

(57) ABSTRACT

A planar reflectarray system provides for bandwidth broadening by employing a tunable (amplitude and phase) feed array. The tunable feed array is adjustable in amplitude and phase to compensate for aberrations by enabling feed re-focusing and field matching. The techniques modestly increase the size of the feed array and use active tuning to effectively correct for de-focusing when operating reflectarrays at frequencies away from the tuned center frequency.

16 Claims, 4 Drawing Sheets

(56) References Cited

U.S. PATENT DOCUMENTS

2006/0145937 A1* 7/2006 Chang ..... H01Q 19/104
343/840
2018/0254547 A1 9/2018 Cwik et al.

* cited by examiner

WIDEBAND REFLECTARRAY USING ELECTRICALLY RE-FOCUSABLE PHASED ARRAY FEED

FIELD OF INVENTION

The present invention relates to systems and methods for increasing bandwidth in reflectarray antennas.

BACKGROUND

A conventional parabolic reflector antenna focuses radio frequency (RF) energy to and from a feed antenna positioned at the focal point of the parabolic reflector. A reflectarray system comprises an array of reflectarray elements (e.g., crossed dipoles printed over a ground plane). The reflectarray elements are arranged to mimic a conventional parabolic reflector by imparting a surface phase shift to create a parabolic distribution. Any electromagnetic radiation (e.g., RF energy) incident on a reflectarray element is re-radiated with a phase shift based on the frequency of the incident electromagnetic radiation.

Planar, fixed beam, reflectarrays have some advantages (e.g., in packaging and cost) over parabolic reflectors, but the bandwidth of reflectarray antennas is fundamentally limited. Typical reflectarray bandwidths vary from approximately 5-20% and depend on two primary factors: 1) the electrical size of the aperture, and 2) the focal length (f) to aperture diameter (D) ratio, or f/D, of the aperture. For instance, a typical offset-fed reflectarray with an aperture diameter D=4.2 meter and an f/D ratio of 1 may have a center frequency of 9.6 GHz and a 594 MHz (i.e., 5.1%) 3 dB gain bandwidth.

One reason for the bandwidth limitation of planar reflectarray antennas is that the aperture path length differences are corrected via surface phasing (not time delays). Another reason for the bandwidth limitation is that the surface phasing element "S-curve" responses have a frequency dependence that cannot readily be optimized over a wide band of frequencies. Typically, the path length difference is the dominant term in determining the bandwidth of the antenna.

SUMMARY

The techniques presented herein provide for bandwidth broadening in planar reflectarrays employing a tunable (amplitude and phase) feed array. The tunable feed array compensates for aberrations by enabling feed re-focusing and field matching. The techniques modestly increase the size of the feed array and use active tuning to effectively correct for de-focusing when operating reflectarrays at frequencies away from the tuned center frequency.

DETAILED DESCRIPTION

While parabolic mesh reflectors have a higher inherent bandwidth than planar reflectarrays due to their parabolic shape, deployable reflectarrays have approximately a five times smaller volume, and are projected to be much lower in cost. The deployable reflectarray technology presented herein provides an alternative to traditional deployable mesh reflectors for space sensor applications that require large antennas. These deployable reflectarray membrane designs have much smaller stowed volume. As such, the deployable reflectarrays are especially well suited for small satellite applications.

Figure 1:
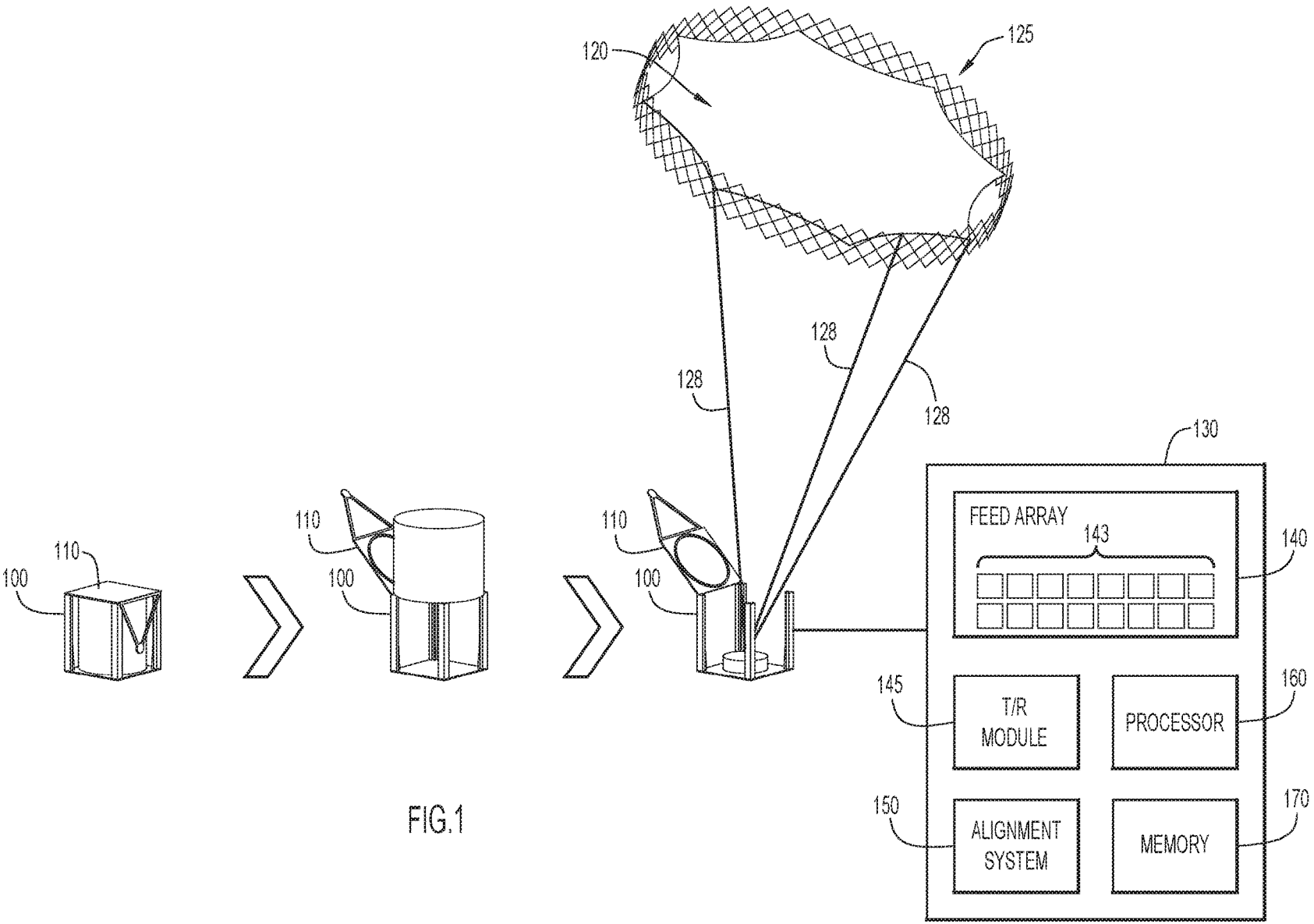
FIG. 1 illustrates an example embodiment of an apparatus configured to deploy a high bandwidth reflectarray antenna.

Referring to FIG. 1, a simplified diagram illustrates the deployment of a printed circuit reflectarray antenna system 100. The system 100 is shown in three stages of deployment in FIG. 1. In the first stage, shown on the left in FIG. 1, the system 100 is in a stowed condition or state in which the printed circuit reflectarray is packed within a container having a lid 110. In the second stage, shown in the center in FIG. 1, the lid 110 opens as the reflectarray is deployed. In the third stage, shown on the right in FIG. 1, the system 100 is fully deployed. When fully deployed, the system 100 includes a planar reflectarray 120 that is supported by a structure 125. Telescoping support members 128 attach the structure 125 supporting the reflectarray 120 to the rest of the system 100. When in the initial stowed configuration (i.e. the first stage shown on the left of FIG. 1) or the intermediary deploying configuration (i.e., the second stage shown in the center in FIG. 1), the reflectarray is a folded membrane that unfolds in a predictable, designed form.

The reflectarray 120 comprises an array of reflectarray elements that re-radiate any incoming electromagnetic radiation with a phase shift based on the frequency of the incoming electromagnetic radiation. The individual reflectarray elements of the reflectarray 120 may be, for example, crossed dipole elements printed over a ground plane. The system 100 also includes a feed structure 130 with a feed array 140 to transmit signals to and/or receive signals reflected from the reflectarray 120. The feed array 140 comprises a plurality of feed array elements 143 (e.g., microstrip patches, patch antennas, waveguide horns, etc.) that are operated in concert to transmit/receive the signals to/from the reflectarray. The system 100 may also include a subreflector to direct electromagnetic radiation between the feed array 140 and the reflectarray 120.

The feed structure 130 also includes a feed network with one or more transmit/receive (T/R) modules 145 that provides signals for the feed array 140 to transmit to the reflectarray 120 and/or obtains the signals received from the feed array 140. In one example, the feed array elements 143 in the feed array 140 may be driven by a feed distribution network (e.g., an RF manifold). Various architectures may be used. For instance, a plurality of T/R modules 145 may be provided wherein each T/R module 145 is associated with a single array feed element 143, or a single T/R module 145 may be associated with multiple feed elements 143. The feed structure 130 may also include an alignment system 150 to ensure the proper alignment between the feed array 140 and the reflectarray 120. In one example, the alignment system 150 may include one or more lasers that illuminate and measure points on the reflectarray 120 and/or the support structure 125.

The feed structure 130 may further include a processor 160 to process instructions relevant to transmitting and/or receiving communications, and a memory 170 to store data and/or software instructions. In an example embodiment, the processor 160 may be one or more microprocessors or one or more microcontrollers that process signals and may execute instructions for implementing the processes described herein.

Memory 170 may include read only memory (ROM), random access memory (RAM), magnetic disk storage media devices, optical storage media devices, flash memory devices, electrical, optical, or other physical/tangible (e.g., non-transitory) memory storage devices. Thus, in general, the memory 170 may comprise one or more tangible (non-transitory) computer readable storage media (e.g., a memory device) encoded with software comprising computer executable instructions and when the software is executed (e.g., by the processor 160) it is operable to perform the operations described herein.

Figure 2:
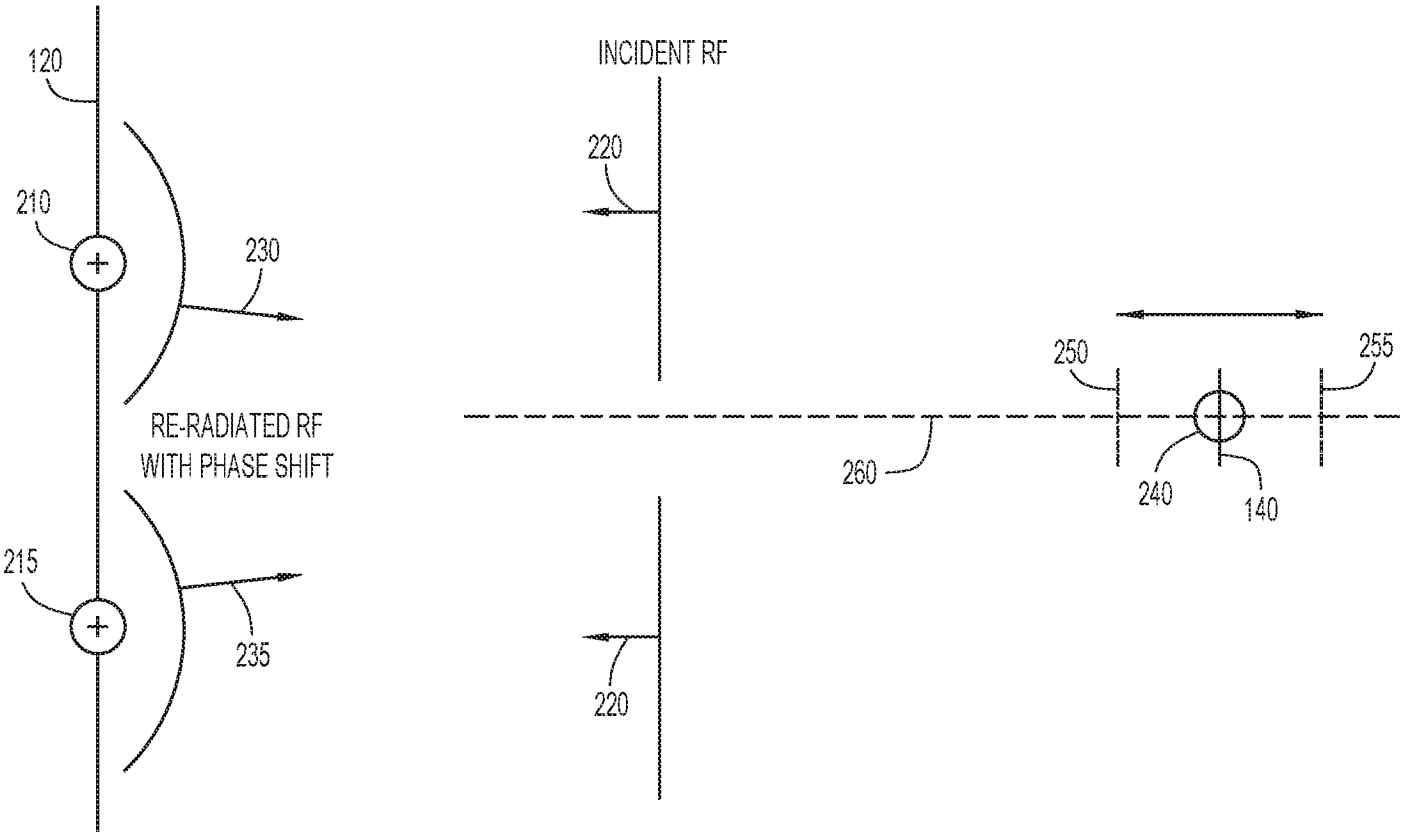
FIG. 2 illustrates an example embodiment of increasing the bandwidth of the reflectarray through axial movement of the phase center of the feed array.

Referring now to FIG. 2, a simplified diagram illustrates an example geometry of a reflectarray antenna and how electromagnetic radiation (e.g., RF energy) is re-rediated by reflectarray elements 210 and 215 to focus the RF energy toward the feed array 140. The system will be described with respect to receiving an incoming RF signal, but similar principles apply to transmitting outgoing RF signals. Additionally, FIG. 2 illustrates a center-fed antenna system, but similar techniques apply to a reflectarray with an offset feed.

An incoming RF signal 220 arrives at the reflectarray 120 essentially as parallel rays, since the source of the signal 220 is relatively far away from the reflectarray 120. When the RF signal 220 hits the reflectarray element 210, the element 210 re-radiates the RF energy with a phase shift as signal 230 emanating from the element 210. Similarly, when the RF signal 220 hits the reflectarray element 215, the element 215 re-radiates the RF energy with a phase shift as signal 235 emanating from the element 215. The phase shift from each reflectarray element causes the re-rediated signals (e.g., signals 230 and 235) to focus at a focal point 240.

Typically, the feed of the reflectarray antenna (e.g., feed array 140) is placed at the focal point 240 to ensure that the reflected signal is focused on the feed. However, to address the path length constraint that limits bandwidth in reflectarray antennas, the actual position of the feed may be adjusted between positions 250 and 255 in the direction of the axis 260 of the reflectarray 120. In the example of FIG. 2, the axis 260 is perpendicular to the reflectarray 120 (i.e., the antenna is configured as a center-fed antenna). Alternatively, the axis 260 may be offset from the perpendicular to the reflectarray 120 through changes to the array of reflectarray elements in the reflectarray 120. The changes in the array of reflectarray elements may angularly offset the axis 260 relative to a perpendicular axis of the reflectarray. Alternatively or additionally, the axis 260 may be laterally offset from a central perpendicular axis.

While the position of the feed may be physically moved along the axial direction, for most applications it is not practical to physically move the feed. As an alternative, the techniques described herein use a stationary feed array 140 and electrically adjust the element phase/amplitude weightings of the feed array elements 143 to move the phase center of the feed array 140 between positions 250 and 255 to achieve the same auto-focus/bandwidth expansion as physically moving the feed achieves. In one example, the phase center of the feed array 140 may be electronically adjusted significantly faster than physically moving the feed. Electronic adjustments may occur at intervals on the order of tens to hundreds of nanoseconds. This enables the system 100 to adjust the phase center of the feed array faster than the data rate of signal transmitted/received by the system 100. Alternatively, a complex feed/beamforming network may create multiple phase centers simultaneously.

Figure 3:
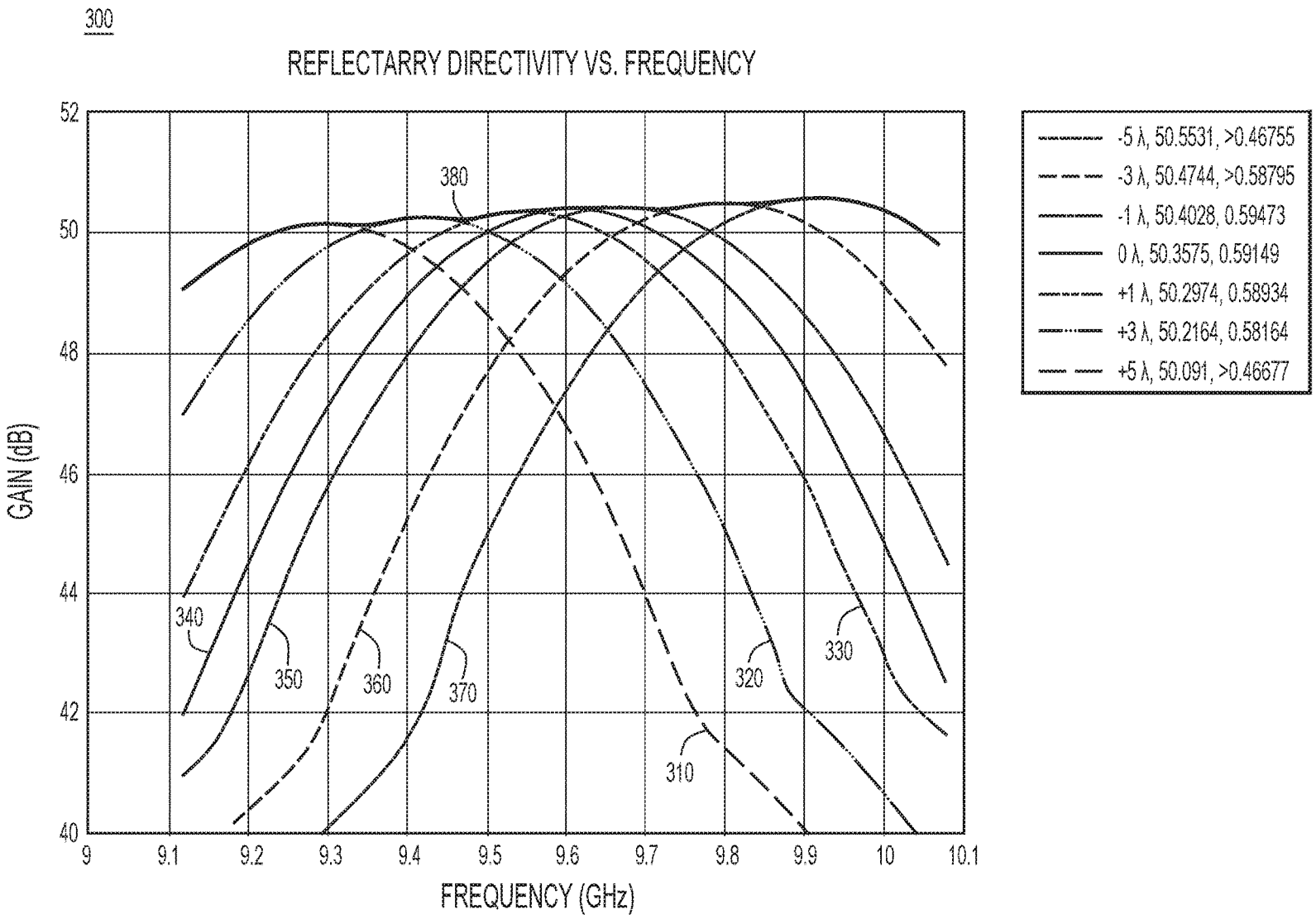
FIG. 3 is a graph illustrating the increased bandwidth of an example embodiment of the reflectarray antenna system.

FIG. 3 shows a graph 300 that illustrates the bandwidth expansion of one example of the reflectarray system 100. In this example, a small feed array 140 (e.g., 37-61 elements) essentially doubles the bandwidth of the reflectarray antenna by moving the phase center of the feed. The graph 300 was generated by a geometric optics model with a feed position that is electrically varied axially by +/−5λ (e.g., approximately six inches at X-band frequencies).

Line 310 illustrates the gain of the reflectarray antenna when the phase center of the feed array is positioned 5λ in front of the focal point (i.e., towards the reflectarray), and results in a gain of 50.1 dB with a bandwidth greater than 467 MHz. Line 320 illustrates the gain of the reflectarray antenna when the phase center of the feed array is positioned 3λ in front of the focal point, and results in a gain of 50.2 dB with a bandwidth of 582 MHz. Line 330 illustrates the gain of the reflectarray antenna when the phase center of the feed array is positioned 1λ in front of the focal point, and results in a gain of 50.3 dB with a bandwidth of 589 MHz.

Line 340 illustrates the gain of the reflectarray antenna when the phase center of the feed array is positioned at the focal point, and results in a gain of 50.4 dB with a bandwidth of 591 MHz. Line 350 illustrates the gain of the reflectarray antenna when the phase center of the feed array is positioned 1λ behind the focal point (i.e., away from the reflectarray), and results in a gain of 50.4 dB with a bandwidth of 595 MHz. Line 360 illustrates the gain of the reflectarray antenna when the phase center of the feed array is positioned 3λ behind the focal point, and results in a gain of 50.5 dB with a bandwidth greater than 588 MHz. Line 370 illustrates the gain of the reflectarray antenna when the phase center of the feed array is positioned 5λ behind the focal point, and results in a gain of 50.6 dB with a bandwidth greater than 468 MHz.

A composite line 380 illustrates the gain of the reflectarray antenna system with combining all of the signals captured in lines 310-370. The gain of the composite line 380 is comparable to the gain illustrated in the line 340 of the center frequency, and retains the gain of ~50 dB for at least double the range of frequencies. In other words, the composite line 380 has at least double bandwidth of the reflectarray in comparison to the fixed focus antenna system described by line 340.

Figure 4:
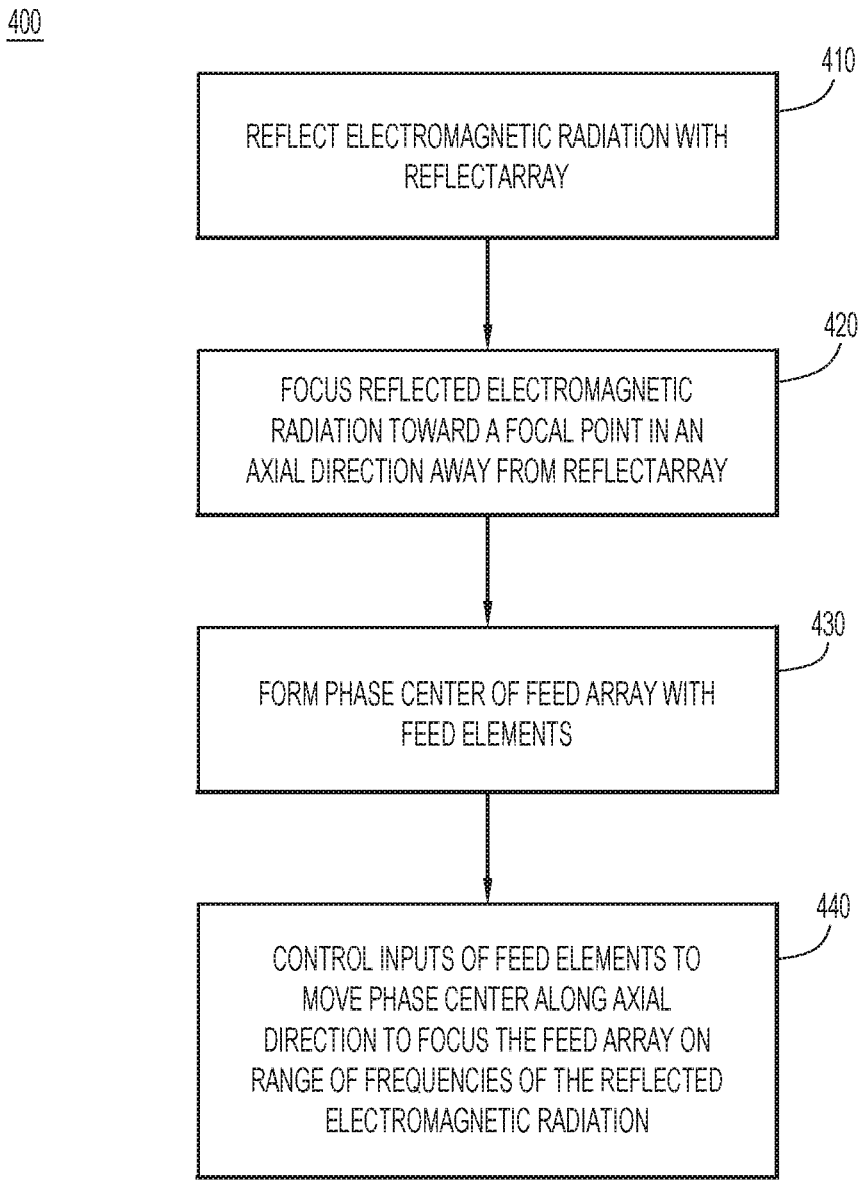
FIG. 4 is a flowchart of a method for increasing the bandwidth of a reflectarray antenna system according to an example embodiment.

Referring now to FIG. 4, a flowchart illustrates a process 400 to increase the bandwidth of a reflectarray antenna system (e.g., system 100). At 410, a reflectarray comprising an array of reflective elements reflects electromagnetic radiation with an adjusted phase based on a frequency of the reflected electromagnetic radiation. In one example, the reflective elements of the reflectarray comprises crossed dipole reflectarray elements. At 420, the reflectarray focuses the reflected electromagnetic radiation toward a focal point in an axial direction away from the reflectarray. The axial direction may be based on the frequency of the reflected electromagnetic radiation and/or the pattern of the array of reflective elements in the reflectarray.

At 430, the system forms a phase center of a feed array with an array of feed elements. At 440, the system controls the inputs of the feed elements to move the phase center of the feed array in the axial direction. In one example, controlling the inputs of the feed elements comprises controlling the amplitude and phase of input signals for the feed elements. Moving the phase center of the feed array in the axial direction focuses the feed array on a range of frequencies of the reflected electromagnetic radiation. In one example, the system may combine the signals from the range of frequencies to increase the bandwidth of the system.

In summary, the techniques described herein electrically adjust the effective position of the feed for a reflectarray antenna to increase the bandwidth of the reflectarray system. Future RF system require greater RF bandwidths to enable advanced radar, wideband (i.e., high data rate) communication, and/or electronic warfare. One application that may benefit from a compact, low cost, high bandwidth RF antenna system with limited moving parts is space platforms (e.g., communication satellites, space-based sensors, etc.).

One or more features disclosed herein may be implemented in, without limitation, circuitry, a machine, a computer system, a processor and memory, a computer program encoded within a computer-readable medium, and/or combinations thereof. Circuitry may include discrete and/or integrated circuitry, application specific integrated circuitry (ASIC), field programmable gate array (FPGA), a system-on-a-chip (SOC), and combinations thereof Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus comprising:

a reflectarray comprising an array of reflective elements, each reflective element configured to reflect electromagnetic radiation with an adjusted phase based on a frequency of the reflected electromagnetic radiation, wherein the array of reflective elements define a focal point in an axial direction away from the reflectarray that is based on the frequency of the reflected electromagnetic radiation;

a feed array comprising an array of feed elements that form a phase center of the feed array; and a transmitter configured to control inputs to the feed elements such that the phase center of the feed array is moved in the axial direction to focus the feed array on a range of frequencies of the reflected electromagnetic radiation.

2. The apparatus of claim 1, wherein the transmitter is configured to move the phase center by electronically adjusting amplitude/phase weightings of the feed elements.

3. The apparatus of claim 1, wherein the reflectarray is configured to deploy from a stowed configuration to a substantially flat expanded configuration.

4. The apparatus of claim 3, wherein the stowed configuration of the reflectarray comprises a folded membrane.

5. The apparatus of claim 3, further comprising an alignment system configured to align the substantially flat expanded configuration of the reflectarray with the feed array.

6. The apparatus of claim 1, wherein the transmitter is part of a transmit and receive module.

7. The apparatus of claim 1, wherein the feed array is offset from a central perpendicular axis of the reflectarray.

8. The apparatus of claim 1, further comprising a processor configured to combine signals with the phase center of the feed array at different positions.

9. A method comprising:

reflecting electromagnetic radiation with a reflectarray comprising an array of reflective elements, wherein the reflectarray reflects the electromagnetic radiation with an adjusted phase based on a frequency of the reflected electromagnetic radiation;

focusing the reflected electromagnetic radiation toward a focal point in an axial direction away from the reflectarray that is based on the frequency of the reflected electromagnetic radiation;

forming a phase center of a feed array with an array of feed elements;

controlling inputs of the feed elements to move the phase center of the feed array in the axial direction, wherein moving the feed phase center in the axial direction focuses the feed array on a range of frequencies of the reflected electromagnetic radiation.

10. The method of claim 9, wherein controlling the inputs of the feed elements to move the phase center comprises electronically adjusting amplitude/phase weightings of the feed elements.

11. The method of claim 9, further comprising deploying the reflectarray from a stowed configuration to a substantially flat expanded configuration.

12. The method of claim 11, wherein deploying the reflectarray comprises unfolding a folded membrane.

13. The method of claim 11, further comprising aligning the substantially flat expanded configuration of the reflectarray with the feed array.

14. The method of claim 9, further comprising transmitting and receiving signals in the reflected electromagnetic radiation via a transmit and receive module.

15. The method of claim 9, further comprising offsetting the feed array from a central perpendicular axis of the reflectarray.

16. The method of claim 9, further comprising combining signals with the phase center of the feed array at different positions.

* * * * *